US012203674B2

(12) United States Patent
Kupka

(10) Patent No.: US 12,203,674 B2
(45) Date of Patent: Jan. 21, 2025

(54) PANEL CONNECTOR WITH AIR DUCT

(71) Applicant: Steinbach & Vollmann GmbH, Heiligenhaus (DE)

(72) Inventor: Andreas Kupka, Albstadt (DE)

(73) Assignee: Steinbach & Vollmann, Heiligenhaus (DE)

( * ) Notice: Subject to any disclaimer, the term of this patent is extended or adjusted under 35 U.S.C. 154(b) by 320 days.

(21) Appl. No.: 17/680,134

(22) Filed: Feb. 24, 2022

(65) Prior Publication Data

US 2022/0390141 A1 Dec. 8, 2022

(51) Int. Cl.
*F24F 13/072* (2006.01)
*F24F 13/02* (2006.01)

(52) U.S. Cl.
CPC ..... *F24F 13/072* (2013.01); *F24F 13/0227* (2013.01); *F24F 13/0263* (2013.01)

(58) Field of Classification Search
CPC .. F24F 13/072; F24F 13/0227; F24F 13/0263; E04B 1/343; E04B 1/61; B60N 2/7017
USPC ..... 52/582.2
See application file for complete search history.

(56) References Cited

U.S. PATENT DOCUMENTS 2,019,692 A * 11/1935 Mueller ..... E04F 15/04 292/109
2,647,287 A * 8/1953 Jones ..... E04B 1/34321 D25/33
2,714,751 A * 8/1955 Stuart ..... F16B 12/20 403/321
3,280,522 A * 10/1966 Palfey ..... E04B 1/6183 52/582.2
3,327,447 A * 6/1967 Nissley ..... F25D 23/063 52/582.2
3,353,314 A * 11/1967 Melcher ..... E04B 1/6183 52/794.1
3,392,497 A * 7/1968 Vantine ..... E04B 1/6183 D25/33
3,661,410 A * 5/1972 Larson ..... E05B 65/0817 52/582.2
3,671,006 A * 6/1972 Berkowitz ..... E04B 2/58 249/97

(Continued)

FOREIGN PATENT DOCUMENTS

DE 2708081 A1 8/1978
DE 3329814 C1 11/1984

(Continued)

*Primary Examiner* — David R Deal
(74) *Attorney, Agent, or Firm* — Von Rohrscheidt Patents

(57) ABSTRACT

A connector configured to couple plural wall elements defining rooms or to couple insulating panels that are formed by filling a cavity with a fluid foam material wherein the connector is encased by the foam material, the connector including a housing that forms a base wall arranged in a base plane and a front wall arranged opposite to the base wall in a front wall plane; a pass-through opening formed in the front wall and configured to receive a locking hook; a receiving cavity configured in the housing for at least one locking element, wherein the housing forms an air duct, wherein the air duct extends from the front plane towards the base plane, and wherein the air duct includes an air inlet opening in the base plane and an air outlet opening in the front plane.

10 Claims, 10 Drawing Sheets

(56) References Cited

U.S. PATENT DOCUMENTS

| | | | | |
|---|---|---|---|---|
| 4,417,430 | A * | 11/1983 | Loikitz | F25D 23/065 52/582.2 |
| 9,109,356 | B2 * | 8/2015 | Segall | E04C 2/38 |
| D844,177 | S * | 3/2019 | Martin | D25/60 |
| 11,486,132 | B2 * | 11/2022 | Gottschling | E04B 1/6116 |

FOREIGN PATENT DOCUMENTS

| | | | |
|---|---|---|---|
| DE | 20208021 | U1 | 8/2002 |
| DE | 102004042864 | A1 | 3/2006 |
| DE | 202020101487 | U1 | 4/2020 |
| EP | 2404530 | A1 | 9/2010 |

* cited by examiner

PANEL CONNECTOR WITH AIR DUCT

RELATED APPLICATIONS

This application claims priority from European Patent Application EP 21 159 159 filed on Feb. 25, 2021 which is incorporated in its entirety by this reference.

FIELD OF THE INVENTION

The invention relates to a panel connector configured to couple plural wall elements.

BACKGROUND OF THE INVENTION

A generic panel connector is known e.g. from DE 202 08 021 U1 and DE 20 2020 101 487 U1 by applicant and DE 10 2004 042 864 A1.

Connectors of this type typically include two components, namely the so-called block and the so-called coupling. A main application is connecting insulation panels that are used for constructing cooling rooms or that are used for insulating cooling rooms. The insulation panels and comparable wall panels for constructing rooms include a circumferential frame which typically supports sheet metal on both sides. The frame includes recesses into which the blocks or the couplings are inserted. Thereafter an insulating foam is injected into the cavity formed by the frame and the sheet metal covering which fixes the housing of the block and of the coupling firmly in the insulating foam after curing.

Each block in a first insulating panel is associated with a coupling in a second insulating panel. The block includes a locking bar in its housing. The coupling includes a pivotable locking hook. The panels are put together with block and coupling aligned. Thereafter, the locking hook is pivoted by a tool from an idle position into an engagement position. Thus, the locking hook passes through the pass-through openings of the coupling housing and of the block housing and reaches behind the locking bar in the block and eventually firmly connects both panels with one another by clamping.

Since the wall panels gain stability by introducing and curing the insulation foam and also acquire their insulating properties that way, the foaming process is particularly important. In particular portions without foam, e.g. through air inclusions have to be prevented. In order to assure a venting of air from the cavity between the sheet metal plates the foam can be introduced in a controlled manner so that the air escapes through the foam inlet opening. Additionally venting bore holes are placed in particular in the frame so that air displaced by the foam can escape from the cavity through the venting bore holes.

Controlling the foaming process as well as placing venting bore holes has disadvantages. The controlling is complex and introducing the venting bore holes into the frame is labor intensive. Furthermore, there is always a problem in that foam material exits through the venting bore holes in the frame and that the wall panel has to be finished in these portions after the foaming which is labor intensive as well.

BRIEF SUMMARY OF THE INVENTION

Thus, it is an object of the invention to provide a reliable solution for venting the cavity when fabricating wall panels which minimizes fabrication labor.

The object is achieved by a connector configured to couple plural wall elements defining rooms or to couple insulating panels that are formed by filling a cavity with a fluid foam material wherein the connector is encased by the foam material, the connector including a housing that forms a base wall arranged in a base plane and a front wall arranged opposite to the base wall in a front wall plane; a pass-through opening formed in the front wall and configured to receive a locking hook; a receiving cavity configured in the housing for at least one locking element, wherein the housing forms an air duct, wherein the air duct extends from the front plane towards the base plane, and wherein the air duct includes an air inlet opening in the base plane and an air outlet opening in the front plane.

According to the invention, there is discretion whether the air duct according to the invention is only formed in the housing of the block or the coupling or in the housing of the block and the coupling. The essential advantages is that the vent openings configured as the air duct formed by the housing are introduced into the wall panel frame by mounting the connectors which has to be done anyhow so that no additional finishing of the panel frame is required. Thus, air displaced by the foam material is vented through the connector housings that are arranged along the circumferential panel frame so that reliable venting is assured.

The invention furthermore proposes to provide the inlet opening with an air permeable foam lock which prevents a passage of foam material into the air duct during wall element production.

This removes another essential advantage of the vent openings in the panel frame namely an exit of foam material. Thus, the foam lock does not impair the venting since the foam typically only reaches the inlet opening of the air duct after the air enclosed in the air duct has been vented from the air duct.

In particular, when the foam lock is a separate component that is inserted into the air duct after producing the connector housing it is very advantageous when the inlet opening forms a pass-through barrier for the foam lock that is inserted between the inlet opening and the outlet opening wherein it can be alternatively provided that the outlet opening forms a pass-through barrier for the foam lock inserted between the inlet opening and the outlet opening.

This pass-through barrier for the foam lock assures that the foam lock cannot be pressed out of the air duct by the foam material so that the foam lock loses its effectiveness. According to the invention a secure support of the foam lock is provided in the air duct.

In order to provide simple assembly of a foam lock configured as a separate component

- the air duct forms a support for the foam lock wherein the foam lock is insertable into the support in an insertion direction;
- the air duct forms guide surfaces upstream of the support in the insertion direction wherein the guide surfaces center the foam lock relative to the support during insertion of the foam lock.

According to an embodiment of the invention, the receiving cavity is part of the air duct wherein the housing forms at least one air inlet opening and the pass-through opening functions as an air outlet opening.

In this embodiment the housing only has to be modified by providing an air inlet opening. The actual air duct is then formed by the receiving cavity that is provided in the housing anyhow and the outlet opening is formed by the pass-through opening for the locking hook that is also provided anyhow.

In a particularly advantageous embodiment of the invention, the housing forms attachment lobes that include a receiving cylinder that is open at a front plane and configured to receive an attachment element wherein the attachment element supports the connector at a wall element frame during the foaming, the receiving cylinder forms an air inlet opening at the base plane, wherein the receiving cylinder forms the air duct.

This embodiment has the essential advantage that the modifications required at the housing are comparatively small. In a best case only the receiving cylinder of the attachment lobe that is provided anyhow has to be extended far enough so that a foam barrier is insertable. If the foam barrier is omitted for any reason or the foam barrier is not reliably supported in the air duct foam material exits in portions that do not cause problems for a function of the connector. This embodiment has the particular advantage that no changes have to be performed at the panel frame in order to implement the air duct.

Furthermore, the attachment element forms at least one relief channel wherein air can exit along the relief channel between the inlet opening and the outlet opening when the attachment element is inserted into the receiving cylinder.

In an advantageous embodiment of the invention, the foam barrier can be arranged in the relief channel of the attachment element.

In another advantageous embodiment of the invention, the front wall forms a tubular channel that extends in a direction towards the base plane and that is configured as an air duct including an inlet opening in the base plane and an outlet opening in the front plane.

This way an air duct is formed as a separate housing element adjacent to the attachment lobe with its receiving cylinder.

The invention also relates to a wall element and a production method for a wall element.

BRIEF DESCRIPTION OF THE DRAWINGS

Additional advantages of the invention can be derived from the subsequent description of an advantageous embodiment with reference to drawing figures, wherein.

DETAILED DESCRIPTION OF THE INVENTION

Figure 1:
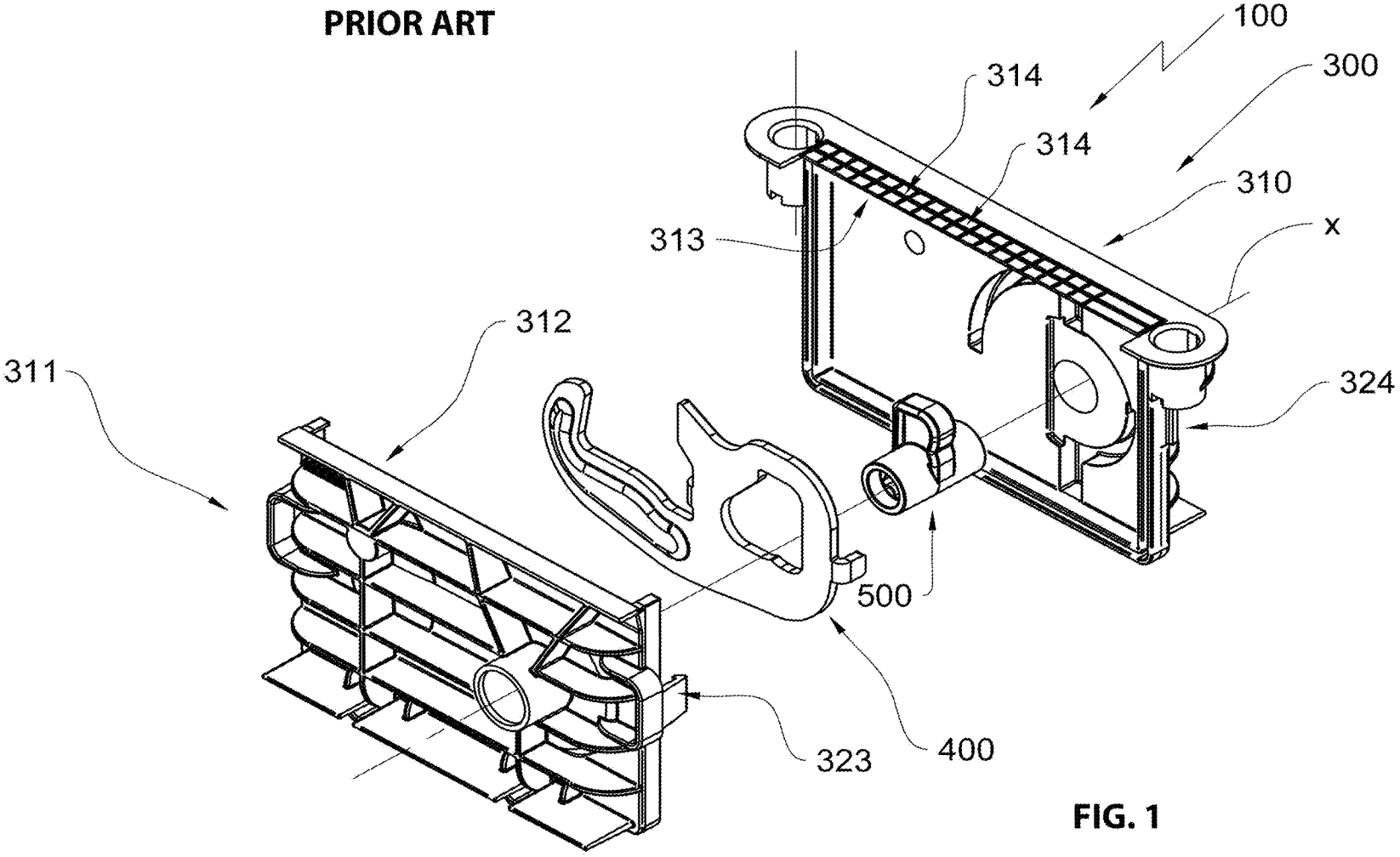
PRIOR ART FIG. 1
FIG. 1 illustrates the coupling of a known generic panel connector.
Figure 2:
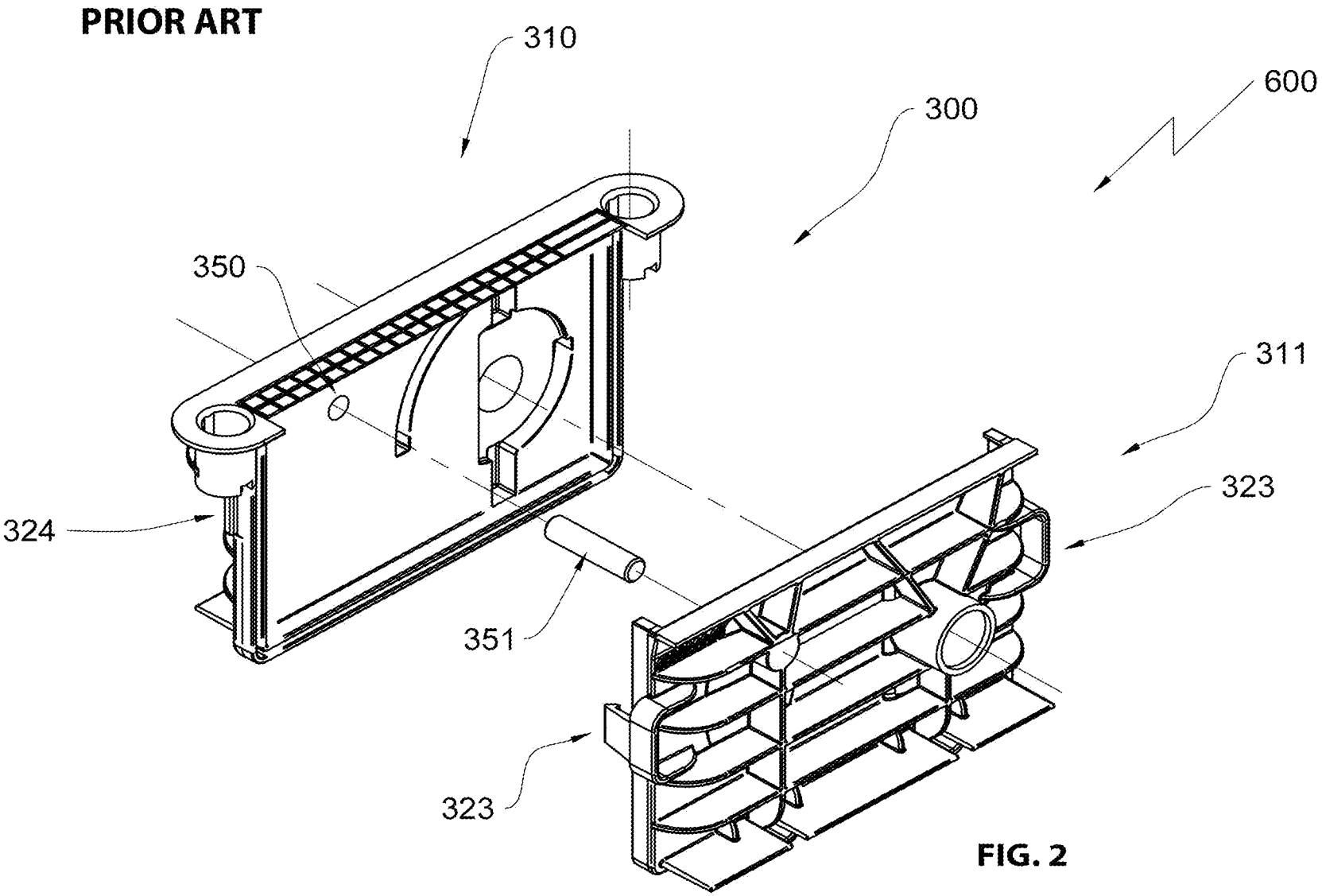
FIG. 2 PRIOR ART
FIG. 2 illustrates the block of a known panel connector.

FIGS. 1 and 2 illustrates a known connector including a coupling 100 and a block 600, showing the basic function of a generic wall panel connector.

The known connector includes a coupling 100 that is shown in FIG. 1 in an exploded view. The coupling 100 includes a housing 300 that is assembled from a first housing half 310 and a second housing half 311. A locking hook 400 is supported in the housing 300 between the housing halves 310, 311 wherein the locking hook is supported on a cam shaft 500 and pivotable in the pivot direction S about a geometric pivot axis x.

The housing 300 forms a pass-through opening 312 from which the locking hook 400 exits during a pivot movement. In the instant embodiment, the pass-through opening 312 is closed by a cover wall 313 which includes non-mandatory but advantageous zones with weakened material 314 in a form of groove shaped embossings. When the housing halves 310 and 311 are assembled the cover wall 313 closes the pass-through opening and thus prevents a penetration of foam material during production of a wall panel.

The housing halves 310, 311 are arranged at one another by fastening devices which are configured in the instant embodiment as interlocking hooks 323 and interlocking protrusions 324.

FIG. 2 shows the counter piece of the coupling, namely the block 600 whose housing 300 is configured identical to the housing of the coupling 100. Therefore, identical reference numerals were used for identical components so that no further explanations are required and the description provided supra is being referred to.

Instead of the locking hook 400, the block 600 includes a locking bar 351 which is fixed in a support opening 350 of the housing 300.

In order to connect two wall panels, they are associated with each other by the coupling 100 and the block 600. The locking hook 400 is pivoted out, moves through the pass-through openings 312 of the housings 300 of the coupling 100 and the block 600 until it reaches behind the locking bar 351.

Thereafter the pivot movement of the locking bar 400 is converted into a linear movement by suitable devices so that the locking hook is moved back into the coupling 100 so that the locking hook is clamped behind the locking bar 351 and connects both wall panels by providing tension there between.

Two embodiments of the invention are now described with reference to FIGS. 3-10. For reasons of simplicity only one connector is shown without differentiating between coupling or block.

Figure 3:
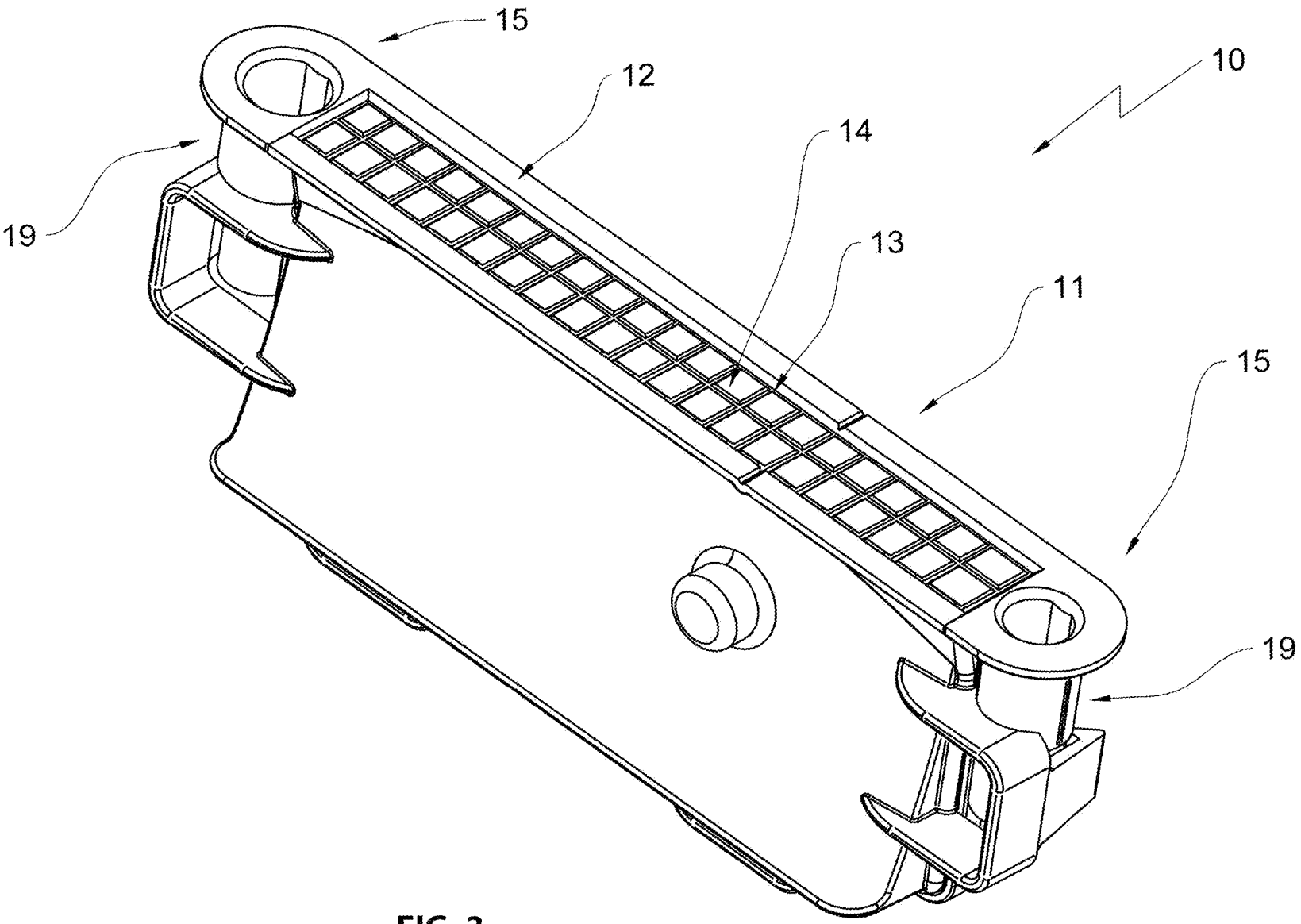
FIG. 3 illustrates a perspective view of a connector according to the instant invention.

The connector according to the invention is overall designated with reference numeral 10 and illustrated in FIG. 3 in a perspective view of the housing 11.

The housing 11 includes a front wall 12 that forms a pass-through opening 13 that is closed by a cover wall 14 protecting against a penetration of foam material or foreign objects.

The housing 11 forms attachment lobes 15 on both sides of the pass-through opening 13, wherein the attachment lobes function to fix the housing 11 in a wall panel frame in order to produce the wall panel.

Figure 4:
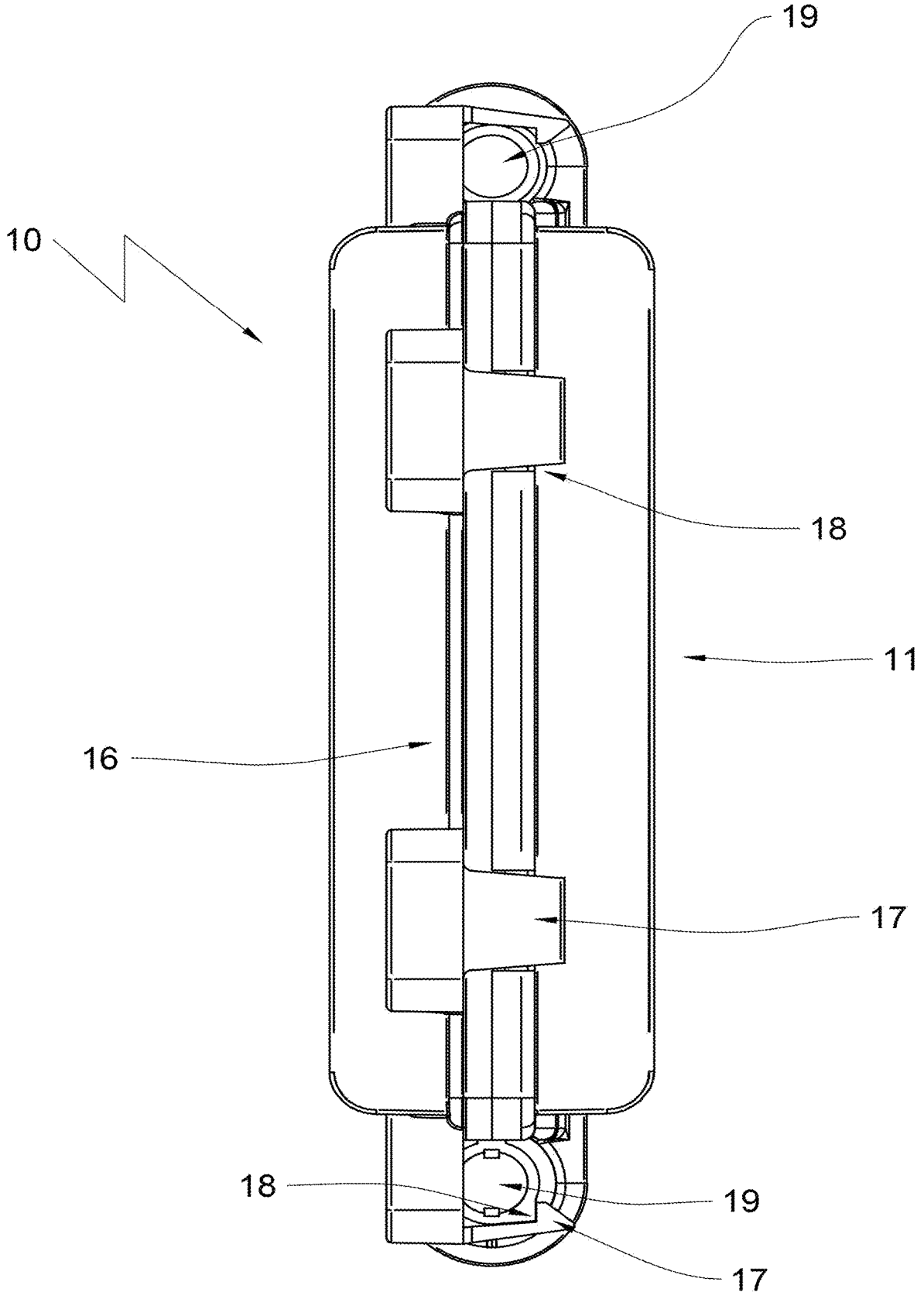
FIG. 4 illustrates the connector according to FIG. 3 showing a view of the housing base.

FIG. 4 shows a view of the connector from below, thus of its base wall 16. It is evident from the combination of FIGS. 3 and 4 that also this embodiment uses a two-piece housing configuration and locking hooks 17 reach behind locking protrusions 18 in order to keep the housing elements together.

Furthermore FIGS. 3 and 4 show that the attachment lobes 15 include receiving cylinders 19.

Figure 5:
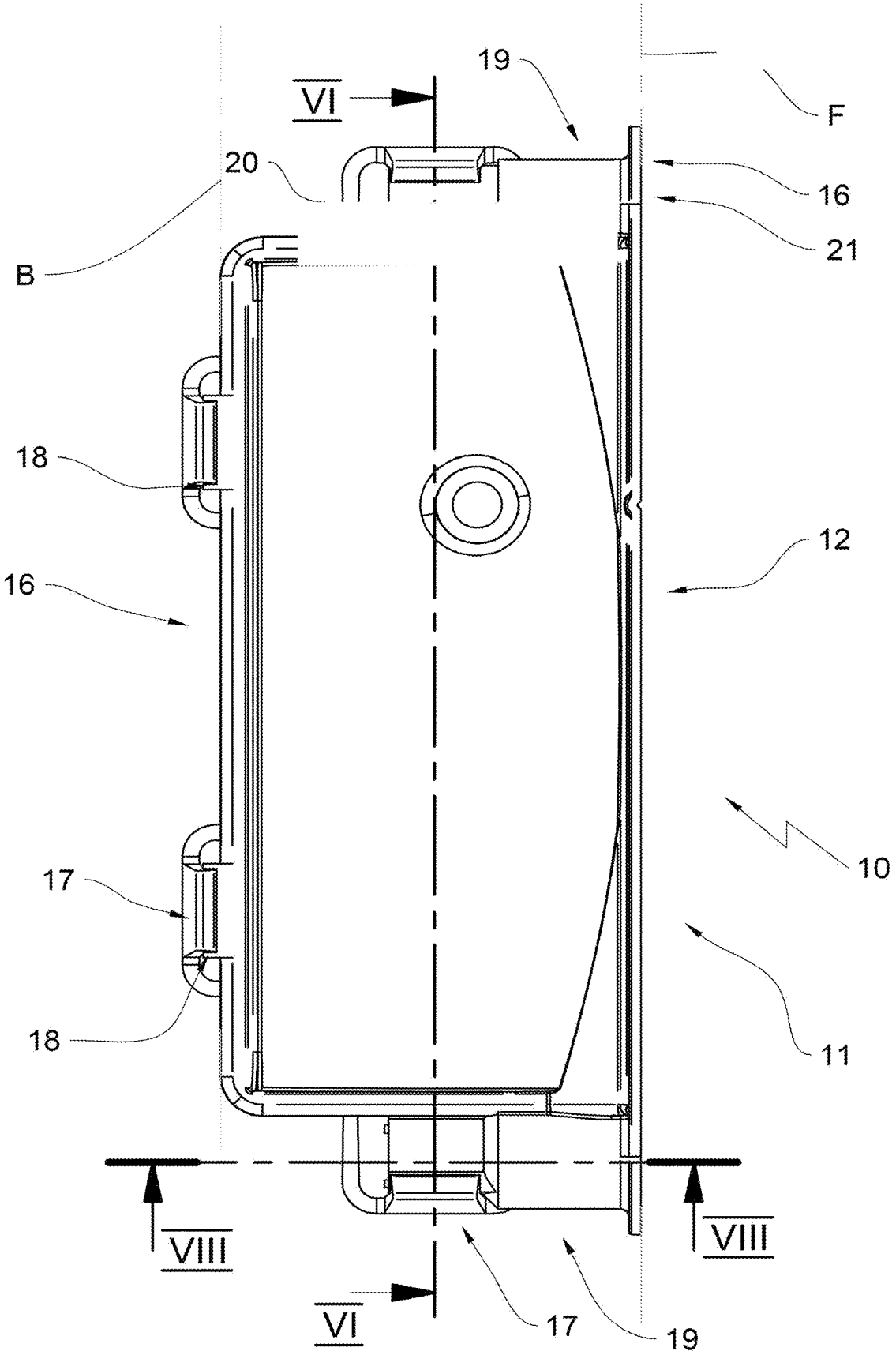
FIG. 5 illustrates a side view of the connector according to FIG. 3.

FIG. 5 shows the connector 10 described supra in a side view. The front wall 12 defines a front wall plane F, the base wall 16 defines a base plane B. It is evident from FIGS. 3 and 4 in combination that the receiving cylinders 19 include an inlet opening 20 in the base plane and an outlet opening 21 in the front wall plane. The inlet opening 20 and the outlet opening 21 define a beginning and an end of an air duct formed by the receiving cylinder 19 wherein the air duct connects the not yet filled cavity with ambient while the connector 10 is not introduced into a panel frame yet so that entering foam can let air included in the cavity of the wall panel blank vent through the receiving cylinder 19.

Figure 8:
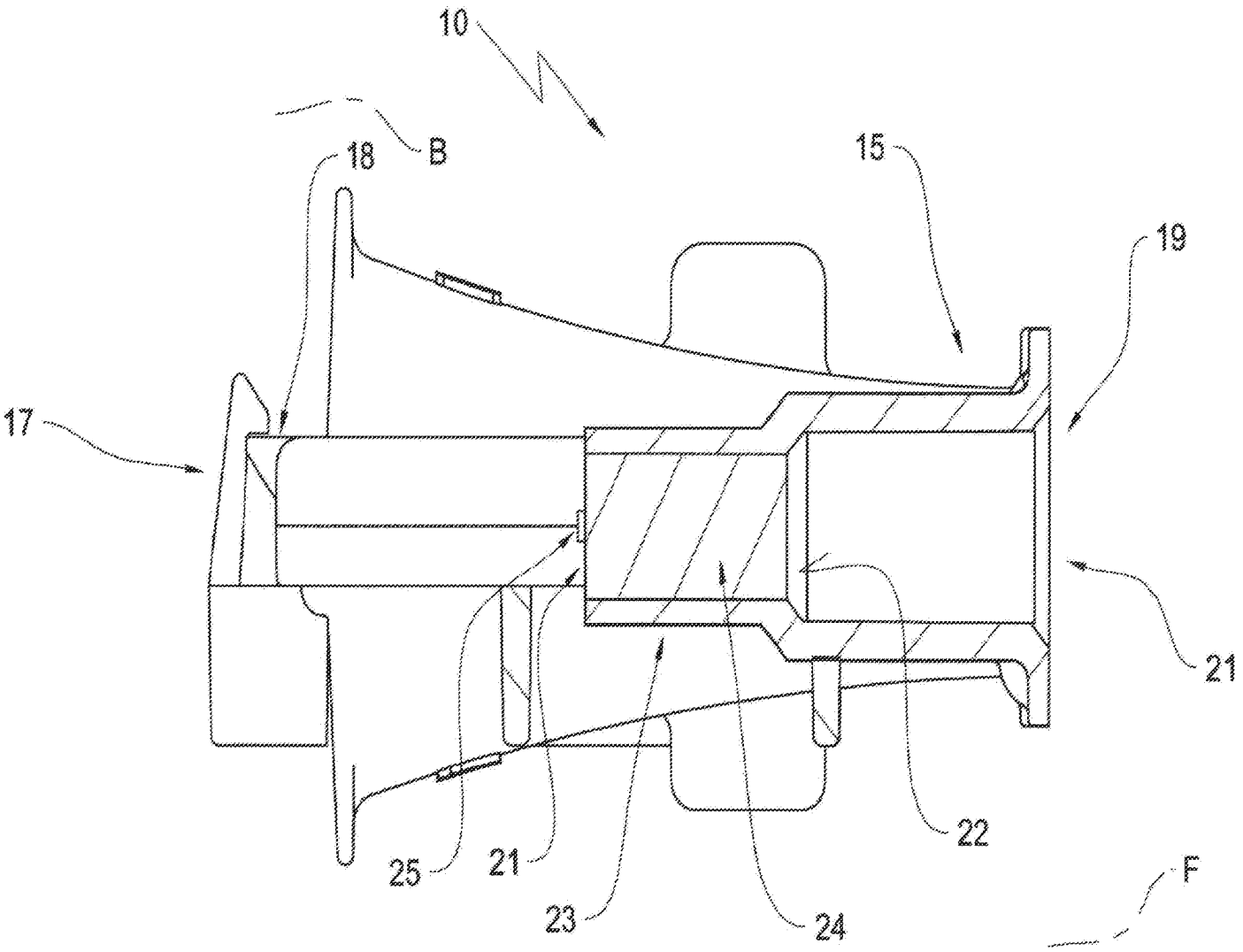
FIG. 8 illustrates a sectional view according to sectional line VIII-VIII in FIG. 5.

FIG. 8 shows a sectional view along the sectional line VIII-VIII of FIG. 5, thus a sectional view through the receiving cylinder 19 of the attachment lobe 15 in the connector 10. A diameter of the receiving cylinder 19 is tapered at a base end in a transition portion between the section with the larger diameter and the section with the smaller diameter of the receiving cylinder 19 and funnel shaped guide surfaces 22 are provided in the transition portion.

The section of the receiving cylinder 19 with the reduced diameter forms a support 23 for a foam barrier 24 which is configured as a separate component in the instant embodiment. The foam barrier is inserted from the front plane F into the receiving cylinder 19, guided with correct positioning by the support surface 22 towards the support 23 and inserted into the support 23. At the inlet opening, a pass-through barrier 25 configured as at least one bar or arm is provided and functions as an end stop for the insertion movement of the foam barrier 24.

Thus, the connector shown in FIGS. 3-8, provides an air duct that is formed by the receiving cylinder 19 with its inlet opening 20 and its outlet opening 21. The foam barrier 24, arranged in the air duct in the base plane prevents a pass-through of still liquid foam material to the ambient during wall panel production which saves complex finishing.

The receiving cylinder 19 additionally attaches the connector 10 in the panel frames. Thus, an attachment element is inserted from the front plane F towards the base plane B into the receiving cylinder 19. In this embodiment the pass-through barrier 25 also prevents an expulsion of the foam barrier element 24 when the attachment element is inserted.

The attachment element includes at least one relief channel in this embodiment of the invention. The relief channel can be configured e.g. as a central pass-through bore hole or as several grooves in the circumferential wall. Exiting air can move from the inlet opening of the receiving cylinder to the outlet opening of the receiving cylinder through the relief channel and flow past the attachment element.

Figure 9:
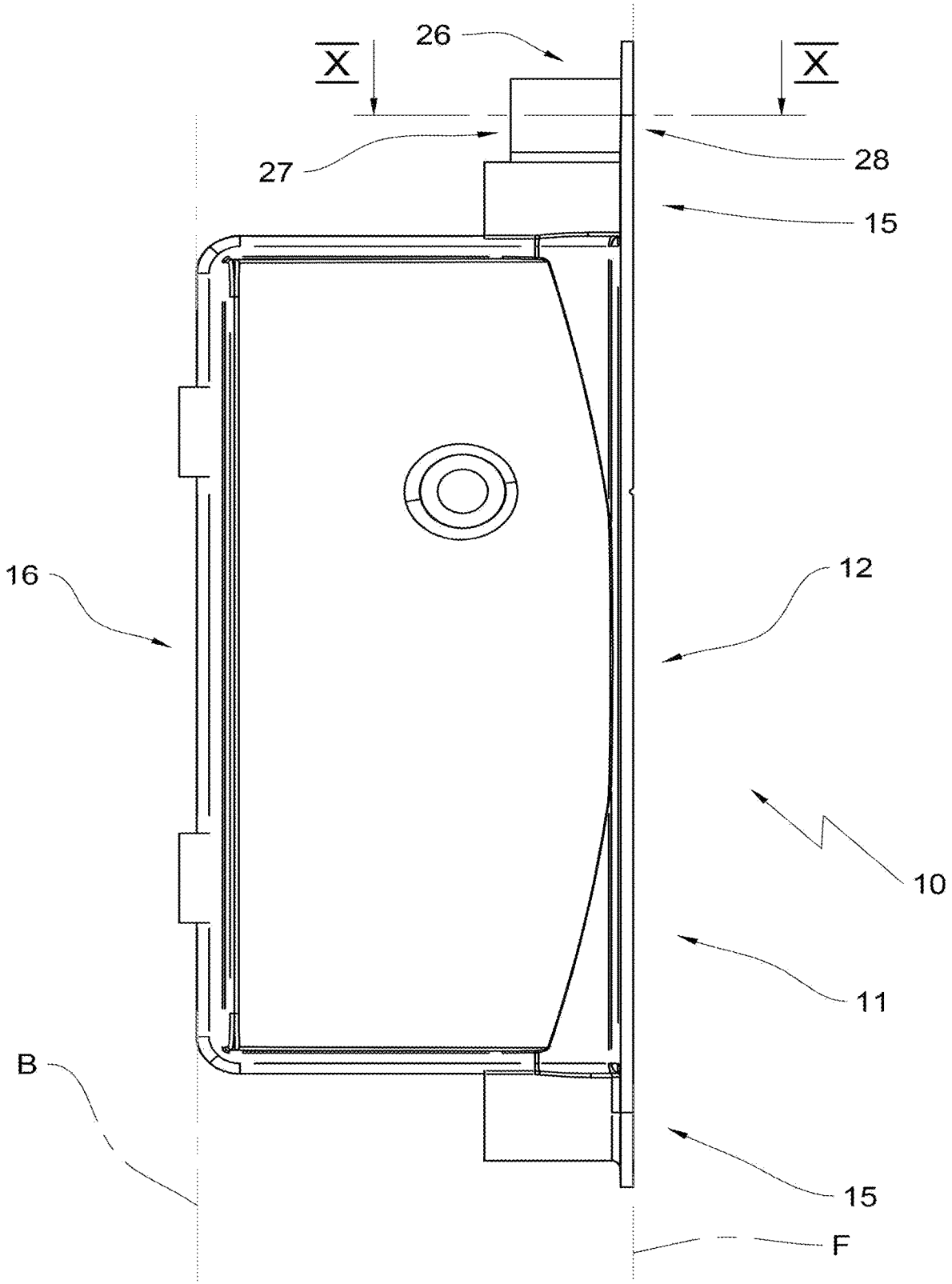
FIG. 9 illustrates a side view of a connector according to the invention in an alternative embodiment.
Figure 10:
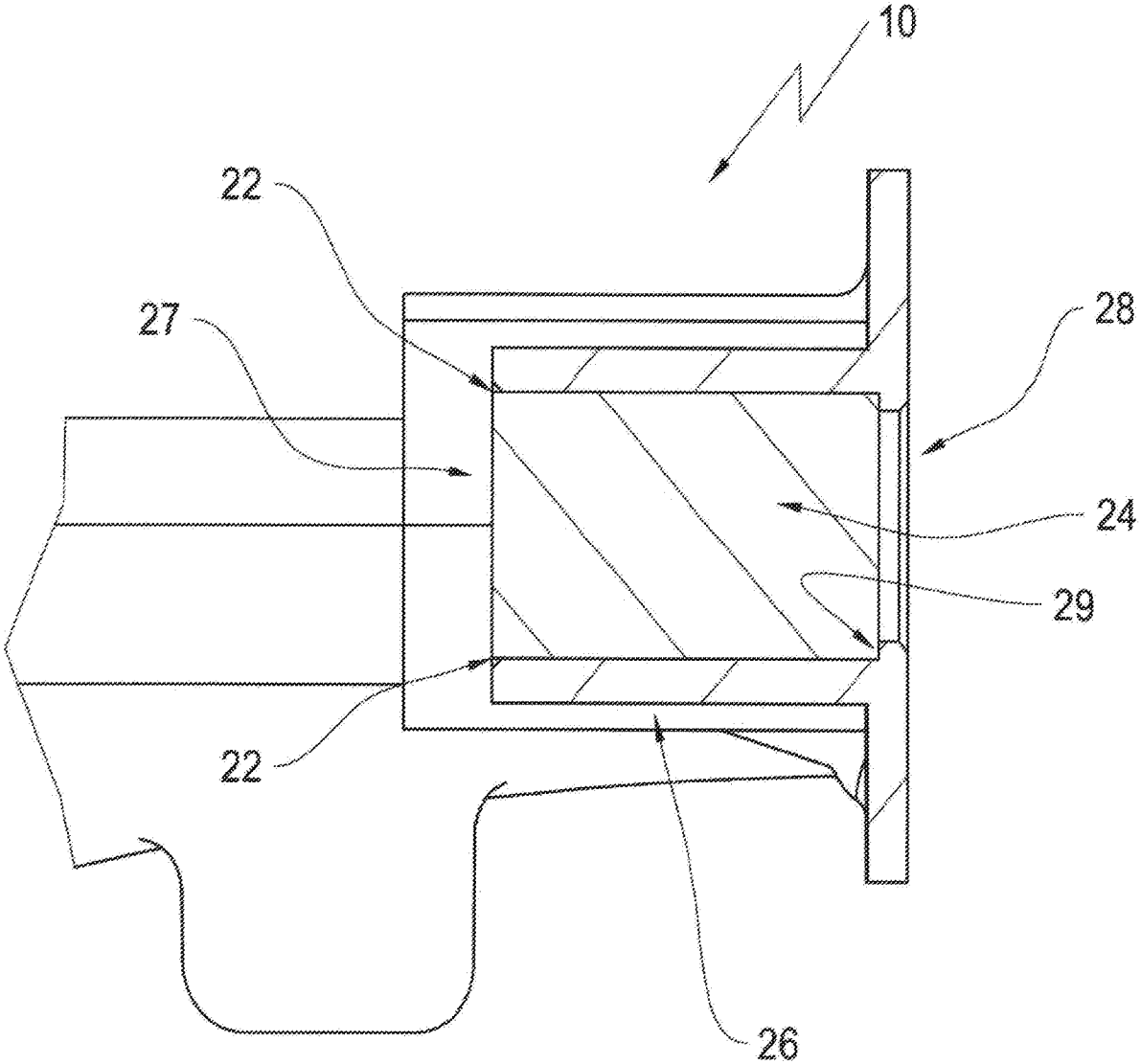
FIG. 10 illustrates a blown-up detail of a sectional view according to the sectional line X-X in FIG. 9.

A second embodiment of the invention is shown in FIGS. 9-11, the connector 10 corresponds essentially to the connector according to the first embodiment so that the description of the first embodiment is referred to. Identical components are designated by identical reference numerals.

Differently from the connector 10 of the first embodiment the housing 11, forms at least one separate tubular channel 26 in addition to the attachment loves 15 wherein the tubular channel extends from the front wall 12 towards the base plane B. The tubular channel 26 includes an inlet opening 27 that is oriented towards the base plane B and an outlet opening 28 that is oriented at the front wall. This separately configured tubular channel 26 functions as an air duct for venting the wall panel blank when foam material penetrates.

FIG. 10 illustrates a sectional view according to the sectional line X-X in FIG. 9 and a blown-up detail view of the tubular channel 26 with an internal foam barrier 24. Also, here the foam barrier 24 is configured as a separate component which, however, does not preclude an integrated foam barrier element from being used according to the invention. The tubular channel 26 also forms guide surfaces 22 in its inlet opening 27, wherein the guide surfaces facilitate an insertion of the foam barrier element 24 in a direction towards the frontal plane. A diameter of the outlet opening 28 is smaller than a diameter of the foam barrier element 24. Thus, the tubular channel 26 forms an annular wall 29 in a portion of the outlet opening 28 wherein the annular wall functions as a pass-through barrier for the foam barrier 24 in this embodiment.

The annular wall 29 prevents in particular that the outlet pressure of the air or the foam material at the inlet opening 27 press the foam barrier element 24 towards the front plane and out of the tubular channel 26.

Figure 6:
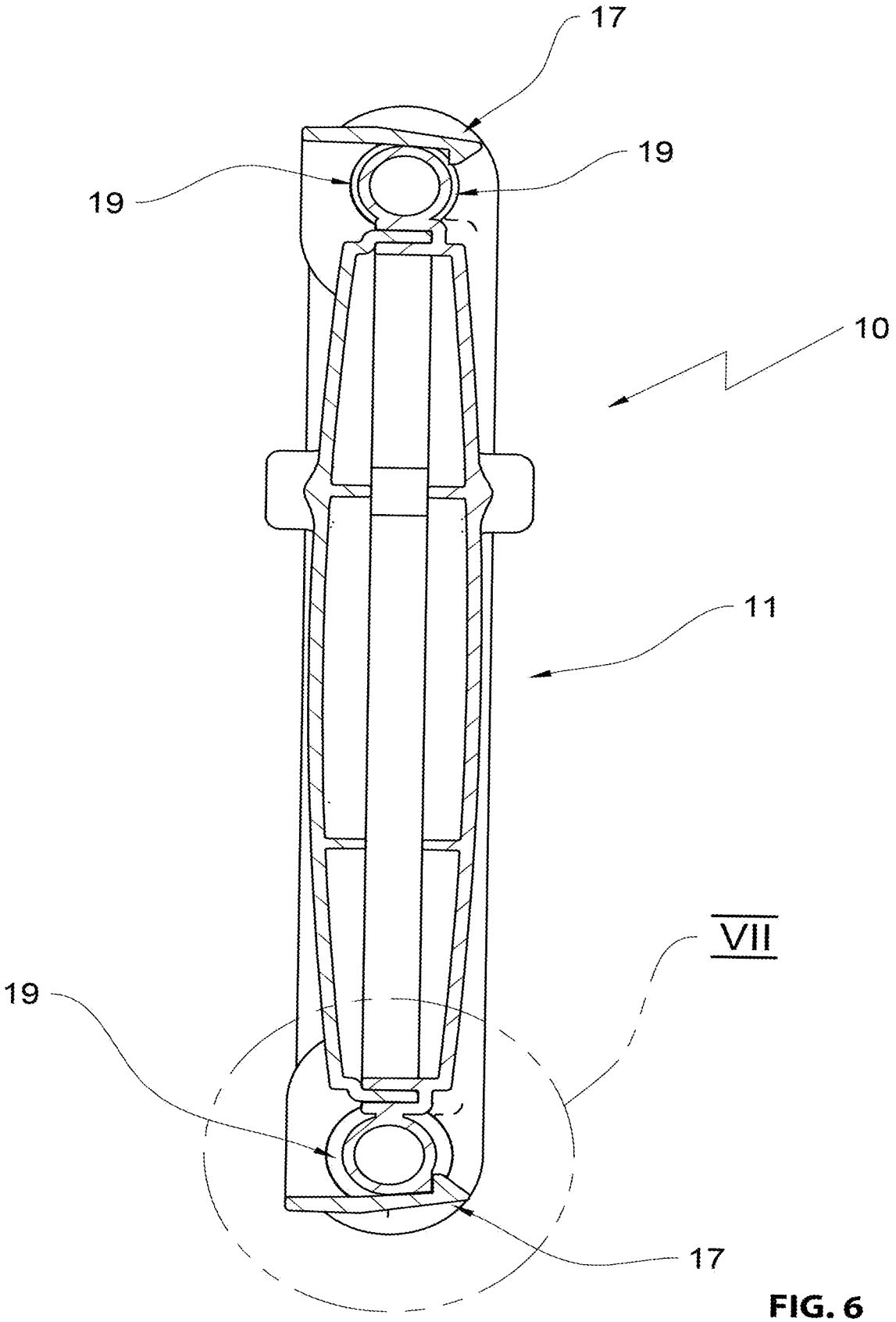
FIG. 6 illustrates a sectional view of the connector according to sectional line VI-VI in FIG. 5.
Figure 7:
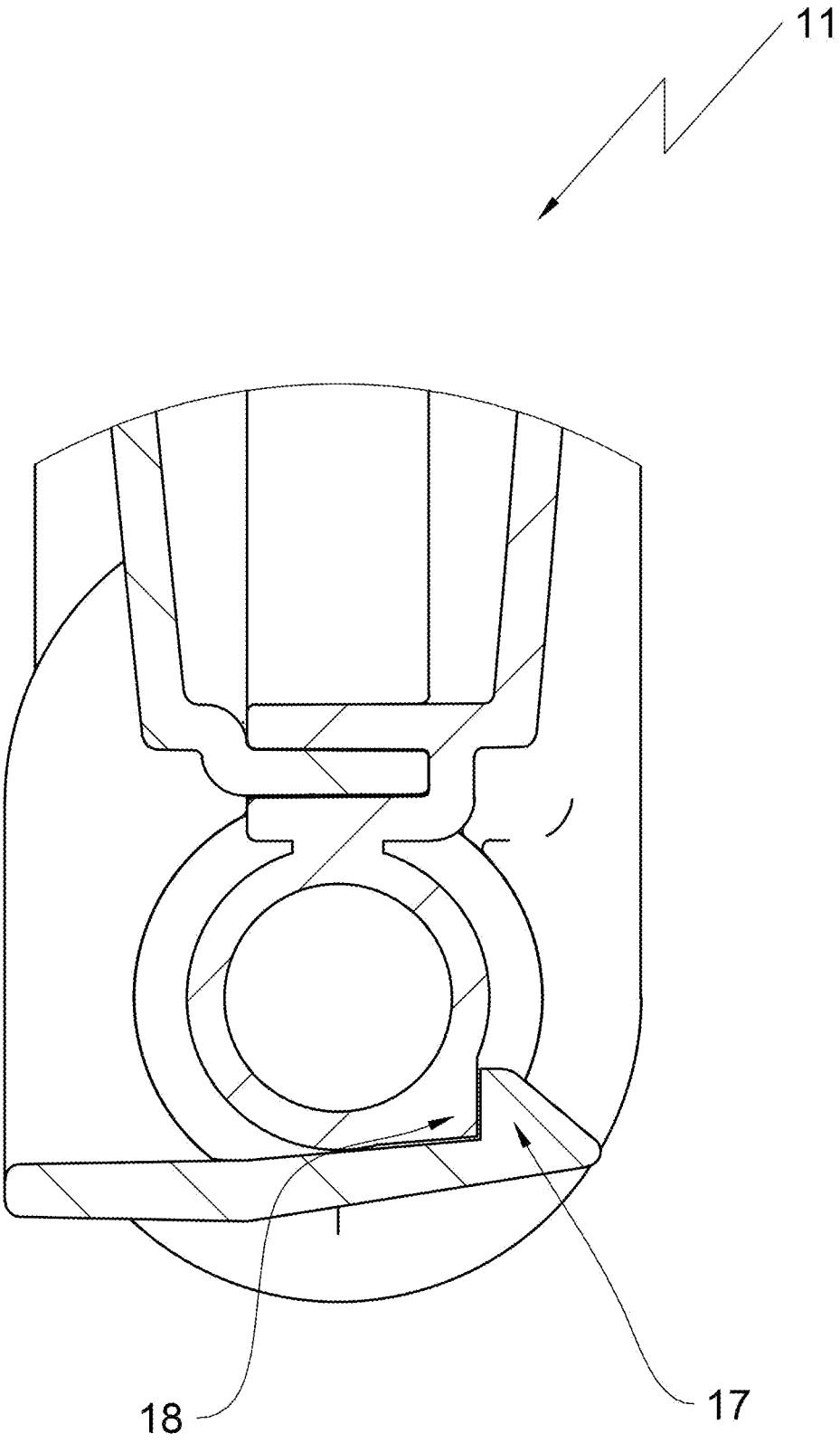
FIG. 7 illustrates a blown-up detail according to detail circle VII in FIG. 6.

FIGS. 6 and 7 show an interlocking of the two housing halves that is different from the prior art. In order to maintain a compact housing while having the receiving cylinder 19 elongated compared to the prior art and while implementing a two-piece connector housing 11 with a simple interlocking attachment, the locking hooks lock at an outer circumference of the receiving cylinder 19 which forms an interlocking protrusion 18 for this purpose.

REFERENCE NUMERALS AND DESIGNATIONS

Known Panel Connector

100 coupling
300 housing
310 first housing half
311 second housing half
312 pass-through opening
313 cover wall
314 weakened material zone
323 interlocking hook
324 interlocking protrusion
350 support opening
351 locking bar
400 locking hook
500 cam shaft
600 block
S pivot direction
x geometric pivot axis

REFERENCE NUMERALS AND DESIGNATIONS

Invention

10 connector
11 housing
12 front wall
13 pass-through opening
14 cover wall
15 attachment lobe
16 base wall
17 locking hook
18 locking protrusion
19 receiving cylinder, receiving cavity, air duct
20 inlet opening
21 outlet opening
22 support surface
23 support
24 foam barrier element
25 pass-through barrier
26 tubular channel

27 inlet opening
28 outlet opening
29 annular wall
B base plane
F front wall plane

What is claimed is:

1. A connector configured to couple plural wall elements defining rooms or to couple insulating panels that are formed by filling a cavity with a fluid foam material wherein the connector is encased by the foam material, the connector comprising:

a housing that forms a base wall arranged in a base plane and a front wall arranged opposite to the base wall in a front wall plane;

a pass-through opening formed in the front wall and configured to receive a locking hook;

a receiving cavity configured in the housing for at least one locking element, wherein the housing forms an air duct, wherein the air duct extends from the front plane towards the base plane, and wherein the air duct includes an air inlet opening in the base plane and an air outlet opening in the front plane, and wherein the inlet opening includes an air permeable foam barrier that prevents a passing of the foam material into the air duct during wall element production.

2. The connector according to claim 1, wherein the inlet opening forms a pass-through barrier for the air permeable foam barrier arranged between the inlet opening and the outlet opening.

3. The connector according to claim 1, wherein the outlet opening includes a pass-through barrier for the foam barrier arranged between the inlet opening and the outlet opening.

4. The connector according to claim 1, wherein the air duct forms a support for the foam barrier into which the foam barrier is insertable in an insertion direction, wherein the air duct forms support surfaces upstream from the support in the insertion direction, and wherein the support surfaces guide the foam barrier towards the support in a centered manner during insertion.

5. The connector according to claim 1, wherein the receiving cavity is part of the air duct, and wherein the housing forms the air inlet opening and the pass-through opening functions as the air outlet opening.

6. The connector according to claim 1, wherein the housing forms attachment lobes that include a receiving cylinder that is open in a front plane and configured to receive an attachment element that supports the connector at a wall element frame during foaming, wherein the receiving cylinder forms an air inlet opening in the base plane, and wherein the receiving cylinder forms the air duct.

7. The connector according to claim 6, wherein the attachment element forms at least one relief channel, and wherein air is capable to escape along the relief channel when the attachment element sits in the receiving cylinder between the inlet opening and the outlet opening.

8. The connector according to claim 1, wherein the front wall forms a tubular channel that extends in a direction towards the base plane and that functions as the air duct and includes the inlet opening in the base plane and the outlet opening in the front plane.

9. A wall element produced by foaming a cavity and foam encasing the connector according to claim 2.

10. A method for producing a wall element produced by foaming a cavity and foam encasing the connector according to claim 2, the method comprising:

filling the cavity by introducing a fluid foam material; and foam encasing the connector according to claim 2 arranged in a frame element of the cavity, wherein air provided in the cavity and displaced by the foam material escapes through the air duct of the connector.

* * * * *